US012790768B2

(12) United States Patent
Hinrichs

(10) Patent No.: US 12,790,768 B2
(45) Date of Patent: Nov. 10, 2026

(54) SPREADING VEHICLE WITH SLOPING SPREADING DISCS AND FILLER PIECE

(71) Applicant: Ludwig Bergmann GmbH, Goldenstedt (DE)

(72) Inventor: Daniel Hinrichs, Friesoythe (DE)

(73) Assignee: Ludwig Bergmann GmbH, Goldenstedt (DE)

( * ) Notice: Subject to any disclaimer, the term of this patent is extended or adjusted under 35 U.S.C. 154(b) by 193 days.

(21) Appl. No.: 18/654,454

(22) Filed: May 3, 2024

(65) Prior Publication Data

US 2024/0376677 A1 Nov. 14, 2024

(30) Foreign Application Priority Data

May 9, 2023 (DE) ..... 202023102514.5

(51) Int. Cl.
*E01C 19/20* (2006.01)

(52) U.S. Cl.
CPC ..... *E01C 19/203* (2013.01)

(58) Field of Classification Search
CPC ..... E01C 19/20; E01C 19/203; E01C 2019/2055; A01C 17/001; A01C 3/06
See application file for complete search history.

(56) References Cited

FOREIGN PATENT DOCUMENTS

DE 102007063868 B3 * 2/2016 ..... E01C 19/203
DE 10 2017 120 048 B4 12/2021

* cited by examiner

*Primary Examiner* — Steven M Sutherland
(74) *Attorney, Agent, or Firm* — Seed Intellectual Property Law Group LLP

(57) ABSTRACT

A spreading vehicle, e.g. universal spreader, comprises at least two spreading discs by which spreading material is thrown. The spreading discs are mounted at the rear end of the spreading vehicle and, on the top side, comprise drivers by which spreading material is captured. The spreading discs rotate with a predetermined rotational speed about their axis of rotation, and are inclined relative to the horizontal, transversely to the travelling direction of the spreading vehicle, by a predetermined non-zero angle. Between the spreading discs, at least partially, a filler piece is arranged to feed spreading material to the spreading discs. The filler piece has a center axis and extends in the direction of the centre axis along a portion having a portion length between the spreading discs. The portion length is greater than a radius of the spreading discs and in cases smaller than twice the radius of the spreading discs.

12 Claims, 4 Drawing Sheets

SPREADING VEHICLE WITH SLOPING SPREADING DISCS AND FILLER PIECE

BACKGROUND

Technical Field

The present disclosure relates to a spreading vehicle, in particular to a universal spreader, wherein the spreading vehicle comprises at least two spreading discs, which are mounted at the rear end of the spreading vehicle and by means of which spreading material is captured from a loading surface of the vehicle and thrown out by the spreading vehicle, wherein the spreading discs on the top side, comprise drivers, by means of which the spreading material is captured, which from the top is continuously conducted or falls onto the spreading discs, wherein the spreading discs rotate with a predetermined rotational speed about their axis of rotation, wherein the spreading discs are inclined relative to the horizontal transversely to the travelling direction of the spreading vehicle by a predetermined angle ≠0° where in between the spreading discs at least partially a filler piece is arranged, wherein the filler piece comprises a center axis and extends in the direction of the center axis along a portion with a portion length between the spreading discs.

Description of the Related Art

Spreading vehicles are known from the prior art. Spreading vehicles are regularly employed in order to discharge different types of spreading material. It can also be manure, leaves, compost, biotreatment sludge, lime, all types of stable dung and further organic agricultural fertilizers, depending on the requirement for the pasture land or a field or the like are deposited. In classic spreading vehicles, the spreading pattern, which the vehicle produces with the spreading material, is substantially predetermined by the rotational speed of the spreading discs. An increase or reduction of the working width can only be achieved up to a certain degree by increasing or reducing the rotational speed of the spreading discs.

Further, from DE 2017 120 048 B4 a spreading vehicle with inclined spreading discs is known. The spreading discs are inclined relative to the horizontal transversely to the travelling direction of the spreading vehicle by an angle of ≠0°. By inclining the individual spreading discs transversely to the travelling direction, an improvement of the spreading pattern is brought about. A more even spreading pattern is created, which significantly exceeds the previous spreading pattern with horizontally oriented spreading discs in terms of the throwing distance and thus the working width. The spreading material is not thrown horizontally sideways but at an arc laterally to the travelling direction upwards and outwards. Thus, the material flies higher through the air and can cover a greater distance before it lands on the ground.

Although the solution known from the prior art has proved itself, there is still room for improvements. In particular, it was observed that with filler pieces known from the prior art, which merely extend in a region and with a length between the spreading discs that is smaller than the radius of the spreading discs, spreading material falls through between the spreading discs in a rear region without being accelerated by the spreading discs. This is disadvantageous for the spreading efficiency and can have a disadvantageous effect on the spreading pattern.

The present disclosure is based on further developing a spreading vehicle of the type described at the outset so that the disadvantages discovered in the prior art are eliminated as largely as possible. In particular, a spreading vehicle is desired in which the feeding of spreading material to the spreading discs and the spreading efficiency with respect to the spreading material is optimized.

BRIEF SUMMARY

According to the present disclosure, a spreading vehicle of the type mentioned at the outset is achieved in which the portion length of the filler piece is greater than a radius of the spreading discs and, in particular, smaller than twice the radius of the spreading discs. The present disclosure is based on the realization that by arranging such a filler piece in the region between the spreading discs it can be avoided that spreading material passes the spreading discs without being accelerated by these. Insofar, the spreading pattern is improved and the spreading efficiency of the spreading vehicle improved. In addition, the effort required for cleaning the spreading vehicle is significantly reduced. The spreading material can be almost completely applied to the surface subjected to the spreading. Losses through unintentional slipping through of spreading material between the rotating discs can thus be reduced to a minimum amount. Preferentially, the portion length of the filler piece is greater than 1.25 times the radius of the spreading disc. According to an embodiment, the portion length of the filler piece is greater than 1.5 times the radius of the spreading disc. According to an embodiment, the portion length of the filler piece is greater than 1.75 times the radius of the spreading disc.

According to an embodiment, the filler piece has a center axis and surfaces originating from the center axis, wherein a first surface, originating from the center axis, extends in the direction of the first spreading disc and a second surface, originating from the center axis, in the direction of the second spreading disc, wherein an angle of inclination of the first surface substantially corresponds to an angle of inclination of the first spreading disc. Preferentially, an angle of inclination of the second surface also corresponds substantially to an angle of inclination of the second spreading disc. The expression substantially is to mean that the angles of inclination of surface and spreading discs are either identical or deviate by ±10 degrees. According to an embodiment, the surfaces are oriented relative to one another in such a manner that these form a roof shape. Thus it is made possible that spreading material is fed to the spreading discs. In this way it is achieved that the spreading material, which is continuously conducted or falls onto the spreading discs from above, in particular when it reaches the region of the filler piece, is conducted through the filler piece in the direction of the spreading discs.

The spreading discs are preferentially arranged in such a manner that these just avoid touching one another in a position of the shortest distance between the spreading discs, and the filler piece can be arranged between the spreading discs. Preferentially, the spreading vehicle is configured as a self-propelled vehicle or as a trailer. Preferentially, the two spreading discs include an angle in the range of a) 150° and smaller than 180° or b) greater than 180° and smaller than 210°.

According to an embodiment, the center axis of the filler piece extends in the travelling direction of the spreading vehicle. Preferentially, the first spreading disc and the first surface form a common plane. According to an embodiment, the second spreading disc and the second surface form a common second plane. In other words, the surface area formed by the surfaces lies at the same height as a surface area of the respective spreading disc adjoining the surface. In this way it is efficiently prevented that spreading material passes the spreading discs without being accelerated by the spreading discs.

According to an embodiment, the first surface on its side facing the first spreading disc has an inside radius which corresponds to an outside radius of the first spreading disc or substantially corresponds to the outside radius of the first spreading disc. According to an embodiment, the second surface on its side facing the second spreading disc has an inside radius which corresponds or substantially corresponds to an outside radius of the second spreading disc. In this way it is avoided that a considerable gap develops between the filler piece and the spreading disc, in which spreading material could settle or pass the spreading discs without being accelerated by these. According to an embodiment, a wall portion adjoining the surface is formed, which, originating from the inside radius of the surface, extends substantially parallel to the axis of rotation of the spreading disc to below the spreading disc. The expression substantially includes a parallel course and deviations of ±5 degrees therefrom. Thus, the stability of the filler piece is increased and it is achieved that accumulation of spreading material below the spreading discs is also largely avoided. According to an embodiment, the inside radius of the surfaces is spaced apart from the outside radius of the spreading disc.

According to an embodiment, the spreading vehicle comprises a spreading chamber in which the spreading discs are at least partially received, wherein the filler piece comprises a first attachment portion, by means of which the filler piece is attached to a, in travelling direction, front limit of the spreading chamber. The first attachment portion is preferentially configured as flat component arranged vertically or substantially vertically and transversely to the travelling direction, in particular as a metal sheet, originating from which the surfaces extend. In this way, a secure attachment of the feeding piece is ensured and it is also avoided by the configuration of the first attachment portion that spreading material is undesirably deposited.

According to an embodiment, the filler piece extends in the direction of the center axis originating from the first attachment portion at least over a position, in which the spreading discs have the least distance to one another, in particular wherein the filler piece, originating from this position, extends by one times the spreading disc radius to twice the spreading disc radius in the direction of the center axis opposite to the travelling direction. In this way it is prevented that spreading material can pass unaccelerated through between the spreading discs.

According to an embodiment, the filler piece comprises a second attachment portion arranged opposite the first attachment portion, by means of which the filler piece is attached to an outlet side of the spreading chamber. Thus, a secure attachment of the filler piece on the two end-faces of the same is ensured.

BRIEF DESCRIPTION OF THE SEVERAL VIEWS OF THE DRAWINGS

In the following, the present disclosure is described in more detail by way of a preferred exemplary embodiment, making reference to the attached figures. In the drawings.

DETAILED DESCRIPTION

Figure 1:
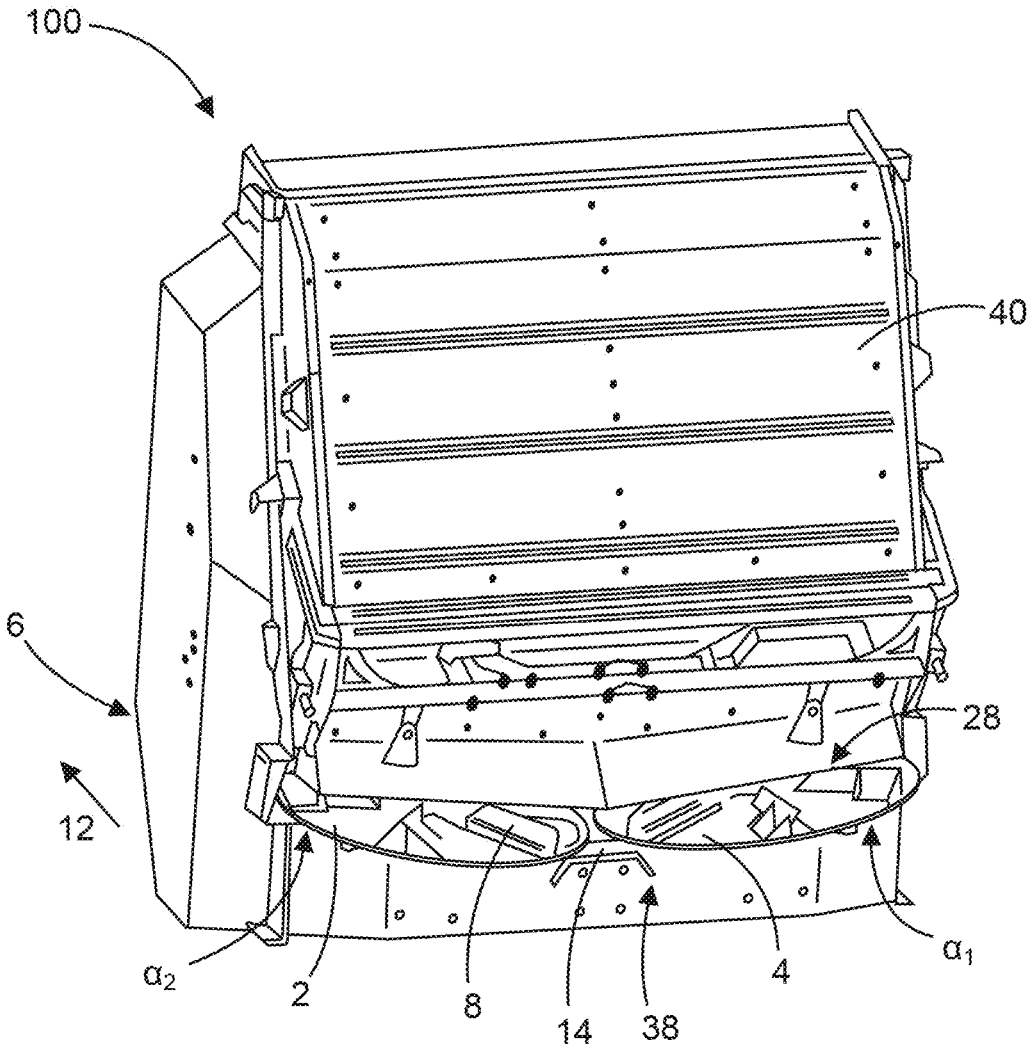
FIG. 1 shows a first exemplary embodiment of a spreading vehicle according to the present disclosure in a perspective rear view.
Figure 2:
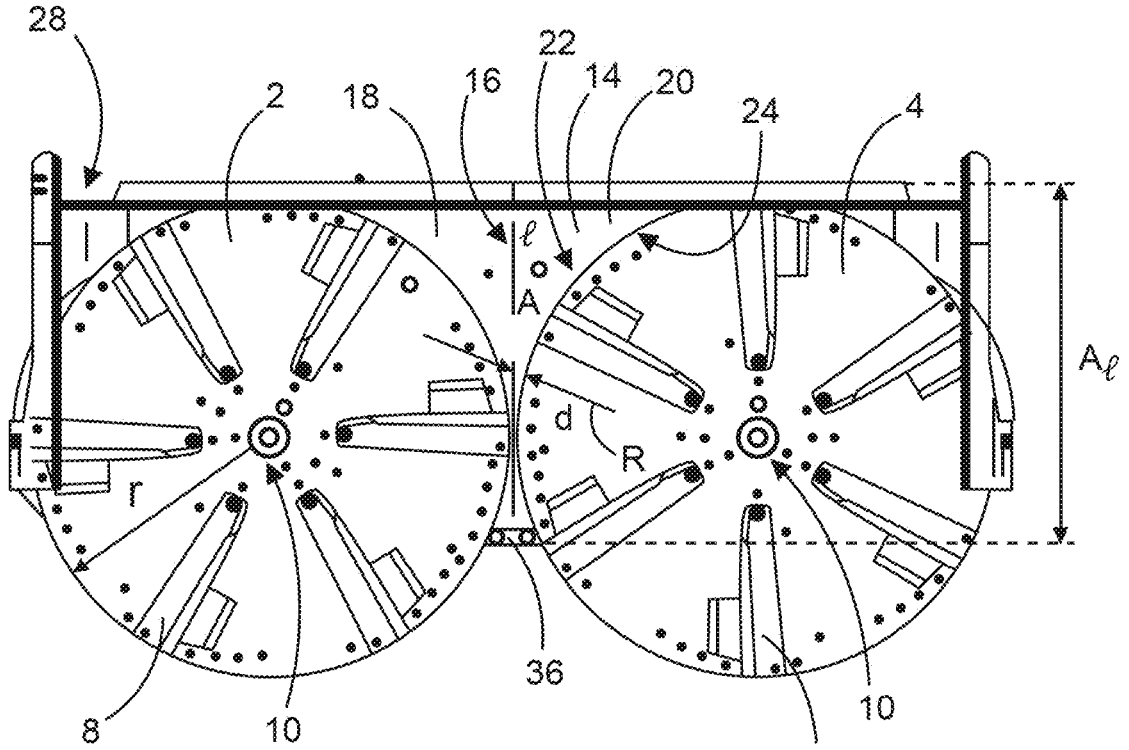
FIG. 2 shows a spreading chamber of the spreading vehicle according to the first exemplary embodiment in a plan view.
Figure 3:
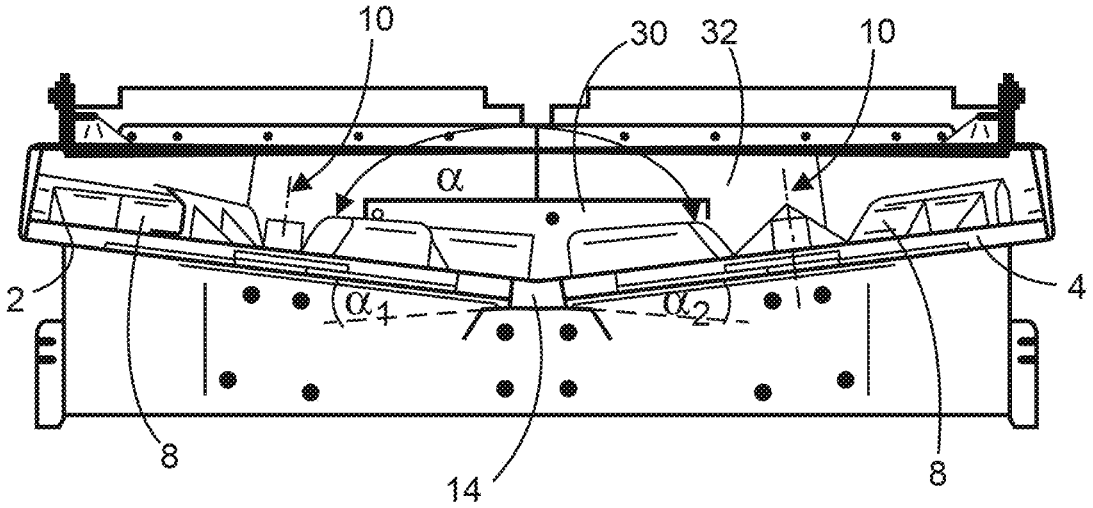
FIG. 3 shows the spreading chamber according to the first exemplary embodiment in a lateral sectional view.
Figure 4:
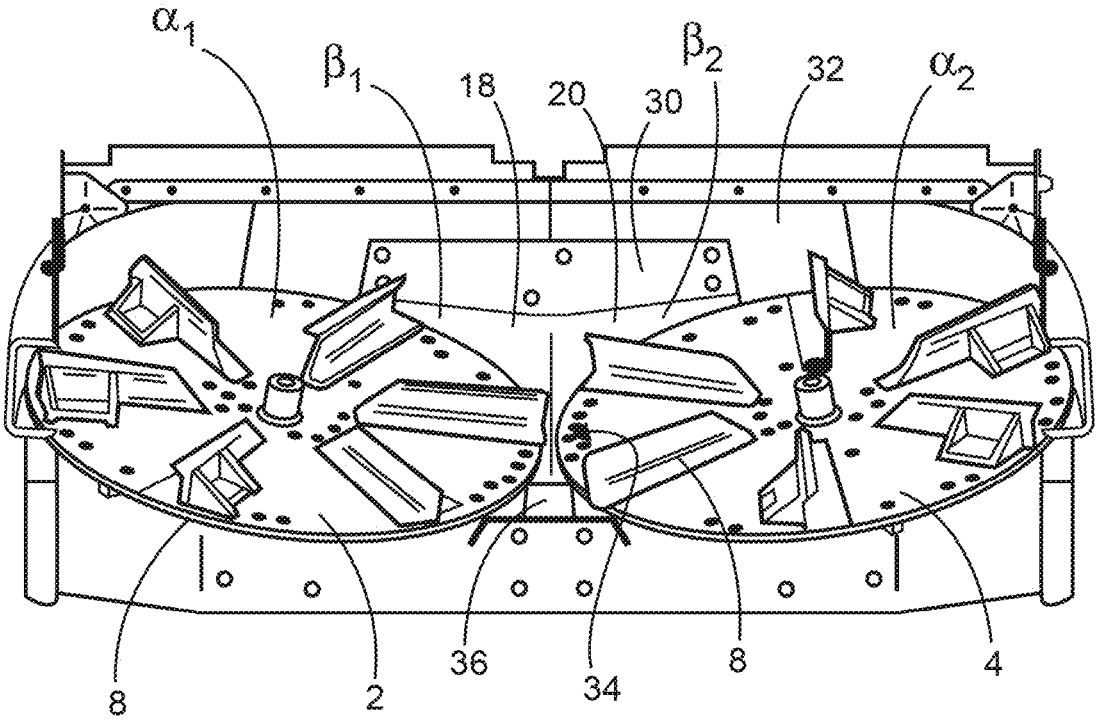
FIG. 4 shows the spreading chamber according to the first exemplary embodiment in a perspective view.
Figure 5:
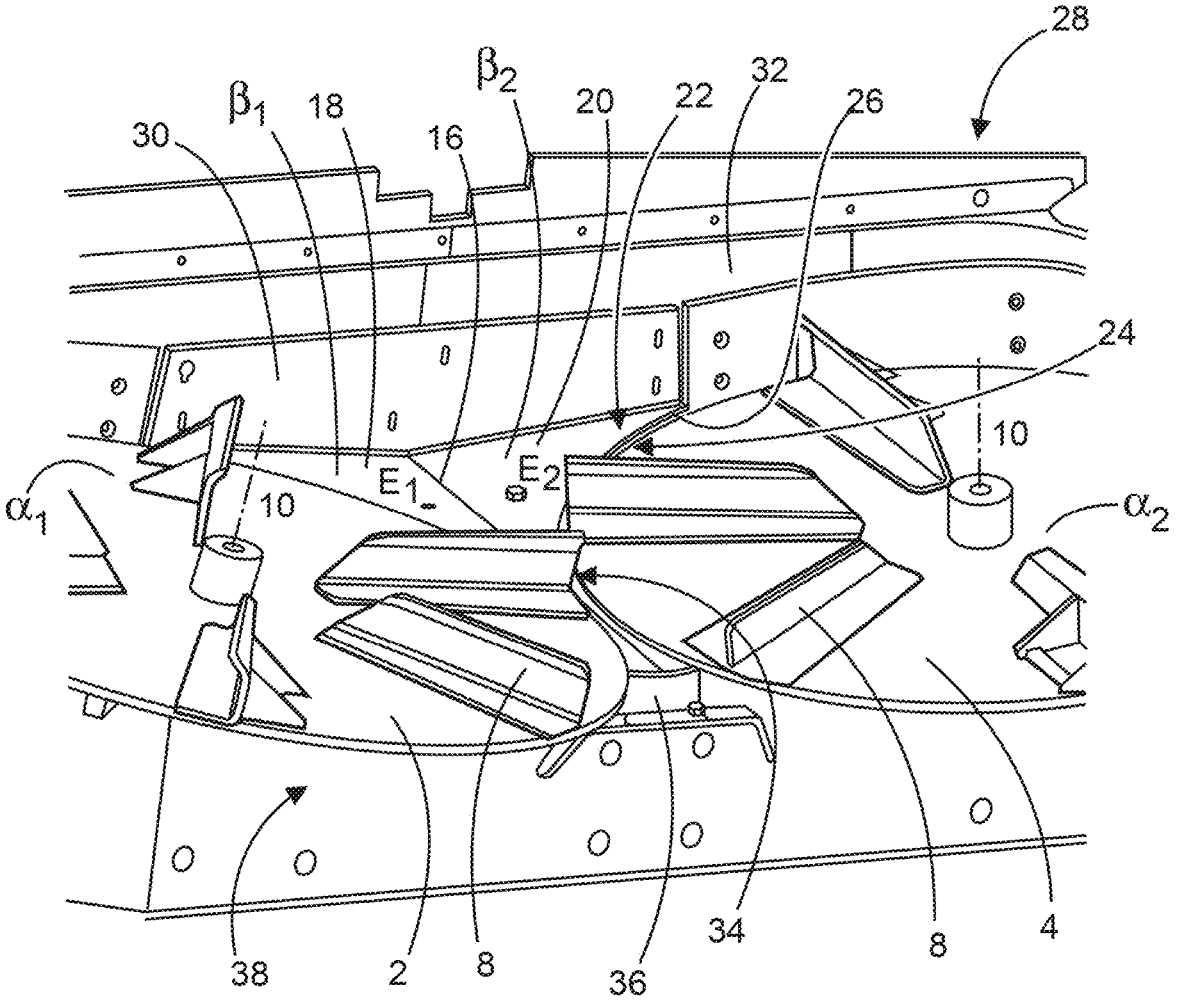
FIG. 5 shows the spreading chamber according to the first exemplary embodiment in a further perspective view.

FIG. 1 shows a spreading vehicle 100, which is configured in particular as universal spreader. In FIG. 1, merely the rear of such a spreading vehicle 100 is shown. The spreading vehicle 100 comprises at least two spreading discs 2, 4, which are mounted at the rear end of the spreading vehicle 100. By means of the spreading discs 2, 4, spreading material is captured from a loading surface 6 (only indicated here) of the spreading vehicle 100 and thrown out by the spreading vehicle 100. For this purpose, the spreading discs 2, 4 comprise top-side drivers 8, by means of which the spreading material is captured, which material is continuously conducted or falls down onto the spreading discs 2, 4 from above. The spreading discs 2, 4 rotate with a predetermined rotational speed about their axis of rotation 10 (see FIG. 2), wherein the spreading discs 2, 4 are inclined relative to the horizontal transversely in the direction of a travelling direction 12 of the spreading vehicle 100, as is noticeable in particular in the FIGS. 3 to 5.

In particular, the first spreading disc 2 has an angle of inclination $\alpha_1$ relative to the horizontal. The second spreading disc 4 has an angle of inclination $\alpha_2$ relative to the horizontal. Between the spreading discs 2, 4 a filler piece 14 is arranged. The spreading discs 2, 4 are arranged in a spreading chamber 28.

The filler piece 14 is equipped in order to avoid that spreading material, which enters the spreading chamber 28, can unaccelerated slip through between the spreading discs 2, 4. The filler piece 14 extends as far as to an outlet side 38 of the spreading chamber 28. The spreading vehicle 100 additionally comprises at the rear end of the spreading vehicle 100 a rear-end flap 40. Further details of the spreading vehicle 100 are shown in the FIGS. 2 to 5 in different views. The filler piece 14 has a center axis 16. Originating from the center axis 16, a first surface 18 and a second surface 20 extend. The first surface 18 extends, originating from the center axis 16, in the direction of the first spreading disc 2. The second surface 20 extends, originating from the center axis 16, in the direction of the second spreading disc 4. The first surface 18 has an angle of inclination $\beta_1$ relative to the horizontal. The second surface 20 has an angle of inclination $\beta_2$ relative to the horizontal. The angle of inclination $\beta_1$ of the first surface 18 substantially corresponds to the angle of inclination $\alpha_1$ of the first spreading disc 2. The angle of inclination $\beta_2$ of the second surface 20 substantially corresponds to the angle of inclination $\alpha_2$ of the second spreading disc 4. The center axis 16 extends in the travelling direction 12 of the spreading vehicle 100. The filler piece 14 extends in the direction of the center axis 16 along a portion A with a portion length $A_1$ between the spreading discs 2, 4, wherein the portion length $A_1$ is greater than a radius r of the spreading discs 2, 4 and, in particular, smaller than twice the radius r of the spreading discs 2, 4.

The first spreading disc 2 and the first surface 18 form a common first plane $E_1$. The second spreading disc 4 and the second surface 20 form a common second plane $E_2$. The first surface 18 on its side facing the spreading disc 2 has an inside radius 22. The inside radius 22 substantially corresponds to an outside radius of the spreading disc 2. The second surface 20 on its side facing the second spreading disc 4 has an inside radius 22. The inside radius 22 substantially corresponds to an outside radius 24 of the second spreading disc 4.

Adjoining the surfaces 18, 20 a wall portion 26 is formed. The wall portion 26 extends, originating from the inside radius 22, substantially parallel to the axis of rotation 10 of the respective spreading disc 2, 4 to below the respective spreading disc 2, 4. The inside radius 22 of the surface 18, 20 is spaced apart from the outside radius 24 of the spreading disc 2, 4. Between the inside radius 22 and the outside radius 24, the spreading discs 2, 4 are spaced apart by a distance d in a radial direction r based on an axis of rotation 10 of the spreading discs 2, 4. The filler piece 14 has a length L along the center axis 16, which is greater than a radius r of the spreading discs 2, 4.

The spreading discs 2, 4 are at least partially received in the spreading chamber 28. The filler piece 14 comprises a first attachment portion 30. By means of the first attachment portion 30, the filler piece 14 is attached to a, in travelling direction, front limit 32 of the spreading chamber 28. The first attachment portion 30 is configured as a flat component, in particular metal sheet, arranged substantially vertically and transversely to the travelling direction 12, originating from which the surfaces 18, 20 extend.

The filler piece 14 extends in the direction of the center axis 16, originating from the first attachment portion 30, at least as far as to a position 34, in which the spreading discs 2, 4 have the least distance to one another. In the shown exemplary embodiment, the filler piece 14, originating from this position 34, extends in the direction of the center axis 16 opposite to the travelling direction 12. Further, the filler piece 14 comprises a second attachment portion 38 arranged opposite the first attachment portion 30. By means of the second attachment portion 36, the filler piece 14 is attached to an outlet side 38 of the spreading chamber 28.

LIST OF REFERENCE NUMERALS

2 First spreading disc
4 Second spreading disc
6 Loading surface
8 Driver
10 Axis of rotation
12 Travelling direction
14 Filler piece
16 Center axis of the filler piece
18 First surface
20 Second surface
22 Inside radius of the filler piece
24 Outside radius of the spreading disc
26 Wall portion
28 Spreading chamber
30 First attachment portion
32 Front limit of the spreading chamber
34 Position of the least distance between the spreading discs
36 Second attachment portion
38 Outlet side of the spreading chamber
40 Rear-end flap
100 Spreading vehicle
A Portion
$A_1$ Portion length
$\alpha$ Angle of inclination of the spreading discs
$\alpha_1$ Angle of inclination of the first spreading disc
$\alpha_2$ Angle of inclination of the second spreading disc
$\beta_1$ Angle of inclination of the first surface
$\beta_2$ Angle of inclination of the second surface
d Distance between surface and spreading disc
$E_1$ First plane
$E_2$ Second plane
l Length of the filler piece
R Radial direction
r Radius of the spreading discs The various embodiments described above can be combined to provide further embodiments. All of the patents, applications, and publications referred to in this specification and/or listed in the Application Data Sheet are incorporated herein by reference, in their entirety. Aspects of the embodiments can be modified, if necessary to employ concepts of the various patents, applications, and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A spreading vehicle, comprising:

at least two spreading discs, which are mounted at a rear end of the spreading vehicle and by way of which spreading material is captured from a loading surface of the spreading vehicle and thrown out by the spreading vehicle, wherein the at least two spreading discs on a top side comprise drivers, by way of which the spreading material is captured, which is continuously conducted or falls down onto the at least two spreading discs from above, wherein the at least two spreading discs rotate with a predetermined rotational speed about an axis of rotation, wherein the at least two spreading discs are inclined relative to the horizontal, transversely to a travelling direction of the spreading vehicle by a predetermined angle $(\alpha)\neq 0°$, wherein between the at least two spreading discs at least partially a filler piece is arranged, which is equipped in order to feed the spreading material to the at least two spreading discs, wherein the filler piece has a center axis and extends in a direction of the center axis along a portion with a portion length between the at least two spreading discs, wherein the portion length is greater than a radius of the at least two spreading discs; and wherein:

the filler piece comprises surfaces originating from the center axis, wherein a first surface, originating from the center axis, extends in a direction of a first spreading disc, and a second surface, originating from the center axis, extends in a direction of a second spreading disc; and an angle of inclination of the first surface substantially corresponds to an angle of inclination of the first spreading disc and/or an angle of inclination of the second surface substantially corresponds to an angle of inclination of the second spreading disc.

2. The spreading vehicle according to claim 1, wherein the center axis extends in the travelling direction of the spreading vehicle.

3. The spreading vehicle according to claim 1, wherein the first spreading disc and the first surface form a common first plane and/or wherein the second spreading disc and the second surface form a common second plane.

4. The spreading vehicle according to claim 1, wherein the first surface and/or the second surface, at a side facing the spreading disc, has an inside radius which substantially corresponds to an outside radius of the spreading disc.

5. The spreading vehicle according to claim 4, wherein adjoining the first surface and/or the second surface a wall portion is formed, which, originating from the inside radius, substantially extends parallel to the axis of rotation of the first spreading disc and/or the second spreading disc, respectively, to below the spreading disc.

6. The spreading vehicle according to claim 1, having a spreading chamber, in which the at least two spreading discs are at least partially received, wherein the filler piece has a first attachment portion by way of which the filler piece is attached to a front limit of the spreading chamber in a travelling direction.

7. The spreading vehicle according to claim 6, wherein the first attachment portion is configured as a flat component arranged substantially vertically and transversely to the travelling direction, originating from which the surfaces of the filler piece extend.

8. The spreading vehicle according to claim 7, wherein the first attachment portion is configured as a metal sheet.

9. The spreading vehicle according to claim 6, wherein the filler piece extends in the direction of the center axis, originating from the first attachment portion, at least as far as over a position in which the at least two spreading discs have the least distance to one another.

10. The spreading vehicle according to claim 6, wherein the filler piece has a second attachment portion arranged opposite the first attachment portion, by way of which the filler piece is attached to an outlet side of the spreading chamber.

11. The spreading vehicle according to claim 1, wherein the spreading vehicle is a universal spreader.

12. The spreading vehicle according to claim 1, wherein the portion length is smaller than twice the radius of the at least two spreading discs.

* * * * *